US008336562B2

(12) United States Patent
Whyte

(10) Patent No.: US 8,336,562 B2
(45) Date of Patent: Dec. 25, 2012

(54) PONYTAIL CLIP

(76) Inventor: Lisa O. Whyte, Prospect, KY (US)

( * ) Notice: Subject to any disclaimer, the term of this patent is extended or adjusted under 35 U.S.C. 154(b) by 189 days.

(21) Appl. No.: 12/313,442

(22) Filed: Nov. 20, 2008

(65) Prior Publication Data

US 2010/0108089 A1 May 6, 2010

(51) Int. Cl.
*A45D 8/12* (2006.01)

(52) U.S. Cl. ..... 132/275

(58) Field of Classification Search ..... 132/273, 132/275, 276–279; D28/39–41; 63/5.1, 63/35

See application file for complete search history.

(56) References Cited

U.S. PATENT DOCUMENTS

| | | | | |
|---|---|---|---|---|
| 2,261,825 | A | 11/1941 | Brainard | |
| 3,842,849 | A * | 10/1974 | Goodman | 132/273 |
| 5,365,954 | A * | 11/1994 | Rude | 132/275 |
| 5,890,497 | A * | 4/1999 | Tsai | 132/273 |
| 6,293,285 | B1 * | 9/2001 | Schach | 132/200 |
| 6,401,726 | B1 * | 6/2002 | Sonstegard | 132/275 |
| 2004/0237992 | A1 * | 12/2004 | Klug | 132/275 |
| 2005/0056298 | A1 * | 3/2005 | McRoberts | 132/276 |
| 2007/0051133 | A1 * | 3/2007 | Wolff | 63/35 |
| 2007/0175493 | A1 * | 8/2007 | Tandberg et al. | 132/275 |

OTHER PUBLICATIONS http://www.hairglove.com/.
http://www.hairglovecharmed.com/.
http://www.hairglovecharmed.com/HairGlove.asp.
http://wwww.hairingz.com/Detail.asp?offset=0 &ProductNumber=70029.

* cited by examiner

*Primary Examiner* — Robyn Doan
(74) *Attorney, Agent, or Firm* — David W. Carrithers; Carrithers Law Office PLLC

(57) ABSTRACT

An assemblage of components for decoratively retaining ones hair bundled together in a pony tail. The assemblage includes an elastically stretchable band for tightly circumscribing the bundled collection of hair and a decorative clip that detachably anchors it to the ponytail at a position in overlying relation with respect to the elastic band. The clip is an elongate elastically stretchable unit terminating at opposite ends in a respective one of a pair of connecting clasp portions. The clip has a decorative outer face and an inner face on the opposite side. A pin secured to the unit projects at a selected angle from the inner face and projects into the ponytail at a position above the elastic band extending there through and thereby securely retains the clip on the ponytail. The pin preferably has an enlargement such as a spherical ball thereon.

25 Claims, 4 Drawing Sheets

PONYTAIL CLIP

FIELD OF INVENTION

This invention relates in general to hardware for a ponytail hair style and more particularly to a decorative clip for a ponytail and to an assemblage of components that includes an elastic band that goes around a bundle of hair holding the same in a ponytail and a decorative clip that releasably hooks onto the ponytail and overlies the elastic band to conceal the same.

BACKGROUND OF INVENTION

Ponytail hair styles have existed for years and various ties, clips, bands and/or combs have been used to hold one's hair in a ponytail and/or decorate the same.

An object of the present invention is to provide a decorative elastically stretchable ponytail clip that has means associated therewith for anchoring the same to the ponytail.

SUMMARY OF INVENTION

In keeping with the foregoing object there is provided in accordance with one aspect of the present invention a decorative pony tail clip comprising at least two and preferably at least three individual rigid members or segments movably connecting together, each one having a decorative outer face and an oppositely disposed inner face, a pin secured to one of the members by holding means such as welding, soldering, casting, or by adhesion with a glue such as a an epoxy glue or gel. The pin forming a hook with the clip body projects from the inner face at a selected angle of less than 90 degrees thereto for penetrating a collection of hair retained bundled together in a ponytail. Clasp means having first and second detachably inter-connecting portions and an elongate elastically stretchable member anchored at one end thereof to the first clasp portion and anchored at the opposite end thereof to the second clasp portion with means for mounting the individual members in side-by-side relation on the elastically stretchable member.

In accordance with a further aspect of the present invention there is provided an assemblage of components for decoratively retaining ones hair bundled together in a pony tail, the assemblage comprising an elastically stretchable band for tightly circumscribing the bundled collection of hair retaining the same in a ponytail and a decorative clip detachably anchorable to the ponytail at a position in overlying relation with respect to the band and thereby concealing the same. The clip comprises an elongate elastically stretchable unit terminating at opposite ends thereof in respective first and second interconnectible clasp portions. The clip has a decorative outer face and an oppositely disposed inner face and a pin secured to the unit projecting from the inner face at a selected angle thereto for penetrating into the pony tail at a position above the band extending there through and thereby securely retain the clip on the ponytail.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the several views and wherein.

DETAILED DESCRIPTION OF PREFERRED EMBODIMENT

Figure 1:
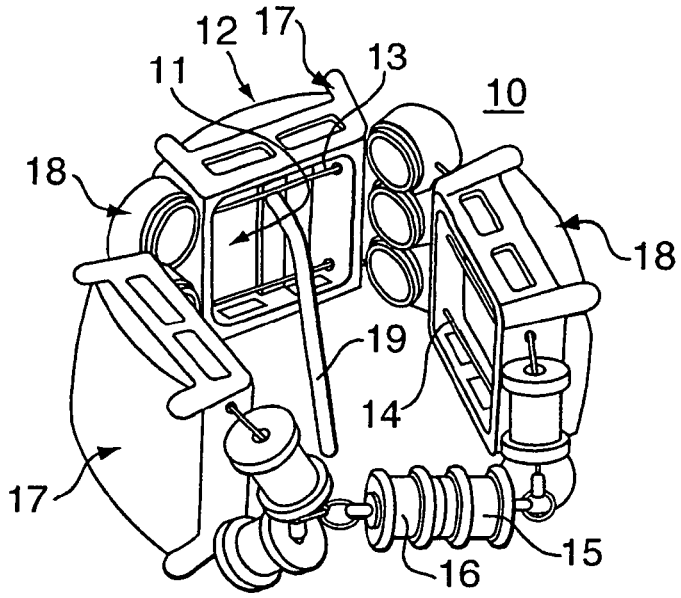
FIG. 1 is an oblique view of a ponytail clip embodiment of the present invention shown in a closed loop state in which the opposite ends of the respective clips are inter connected.
Figure 2:
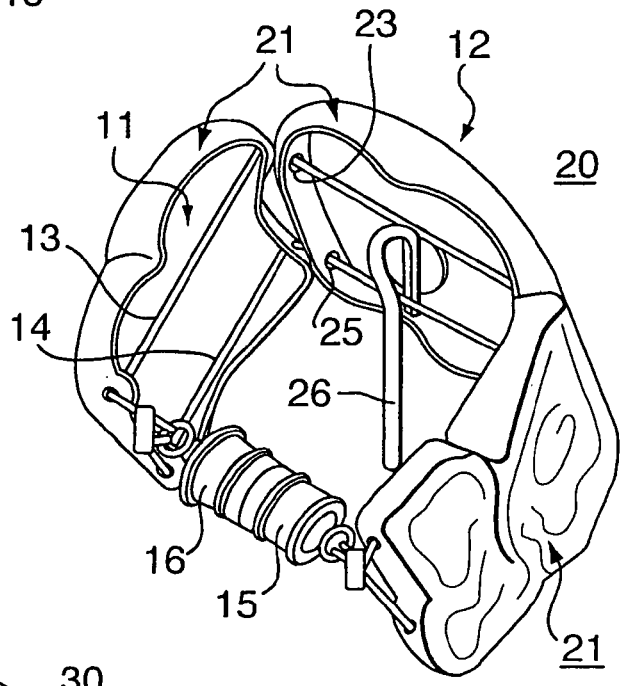
FIG. 2 is an oblique view of a ponytail clip embodiment of the present invention shown in a closed loop state in which the opposite ends of the respective clips are inter connected.
Figure 3:
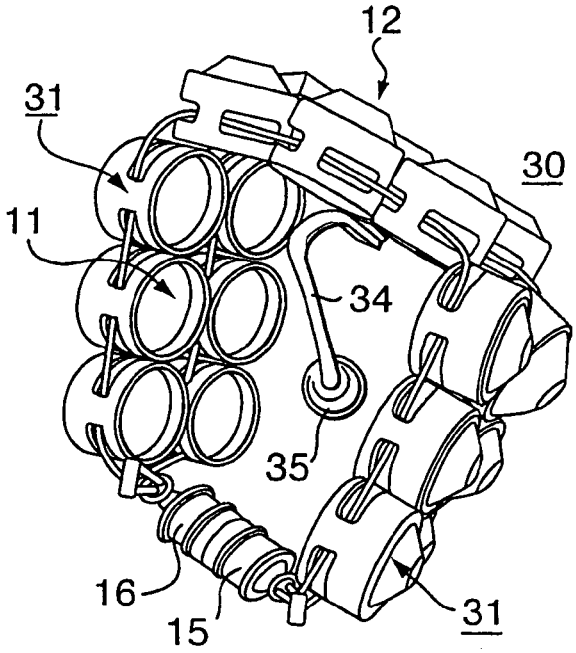
FIG. 3 is an oblique view of a ponytail clip embodiment of the present invention shown in a closed loop state in which the opposite ends of the respective clips are inter connected.

FIGS. 1, 2, and 3 are oblique views of applicants respective ponytail clips 10, 20 and 30 each having respective inner and outer surfaces 11, 12. Each clip includes an elastically stretchable member that has first and second respective spans 13, 14 disposed in spaced apart parallel relation and connected at one end thereof to a first clasp portion 15 and at the opposite end to a second clasp portion 16. These clasp portions are detachably interconnecting and preferably comprise permanent magnets with one clasp portion being of a polarity opposite to that of the other. This permits a simple and easy detachable interconnection of the opposite ends to provide a closed loop clip.

Each clip 10, 20, and 30 is a multi-section flexible elastically stretchable unit. Clip 10 has alternately arranged sections 17 and 18, clip 20 has three side-by-side sections 21 and clip 30 has a plurality of sections 31 arranged in side-by-side parallel rows 32, 33. The sections 21 are for example shaped or molded metal, plastic, glass or stone pieces while sections 17, 18 and 31 are selected ornamental pieces of the same mounted on a metal peripheral frame.

In each instance the elastically stretchable spans 13 and 14 pass through respective ones of a pair of aligned holes in each of the clip sections associated therewith. For example each clip section 21 of clip 20 has a first pair of aligned holes 22, 23 for span 14 and a second pair of aligned holes 24, 25 for the span 13. In the clip 30 row 32 has a first pair of spans 13, 14 and row 33 has a second pair of spans 13, 14. A section 31 in row 32 is connected via a pair of spans to an adjacent section 31 in row 33.

The clip sections 17, 18, 21, and 31 in each instance is freely slidable along the elastically stretchable spans 13, 14 associated therewith. The clip sections 21 are metal with a sculptured (or molded) outer surface with gems, polished stones or the like mounted thereon at positions spaced apart from one another. The clip sections 17, 18 and 31 each have a polished stone, gem, piece of glass, plastic or the like suitably retained by clasps and or suitable adhesives on a metal or the like peripheral frame.

Figure 4:
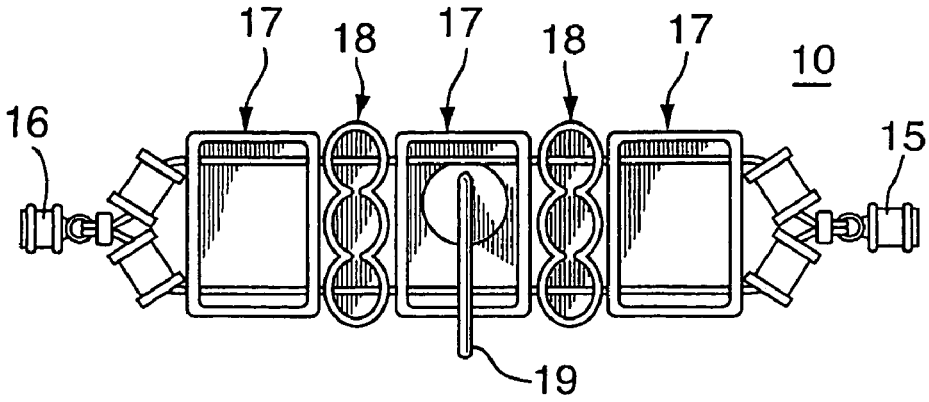
FIG. 4 is an oblique rear face view of the clip shown in respective FIG. 1 in an open lay out elongate state in which the opposite terminal ends are disconnected.
Figure 5:
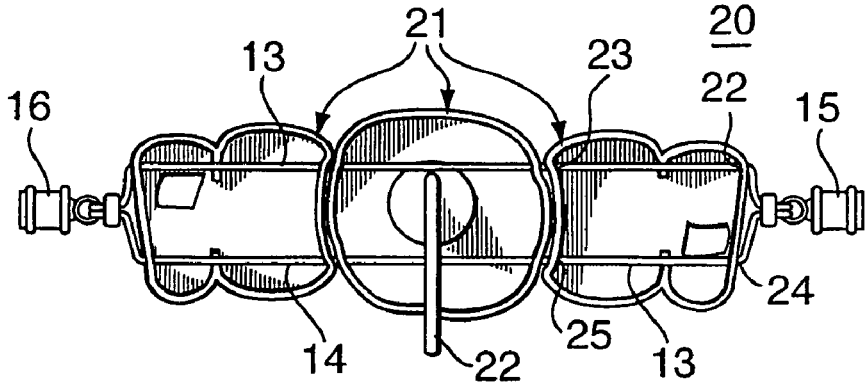
FIG. 5 is an oblique rear face view of the clip shown in respective FIG. 2 in an open lay out elongate state in which the opposite terminal ends are disconnected.
Figure 6:
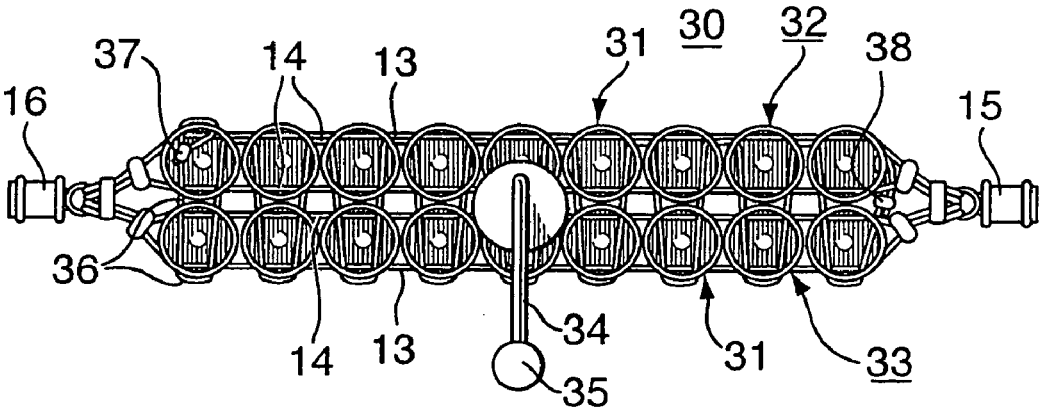
FIG. 6 is an oblique rear face view of the clip shown in respective FIG. 3 in an open lay out elongate state in which the opposite terminal ends are disconnected.
Figure 7:
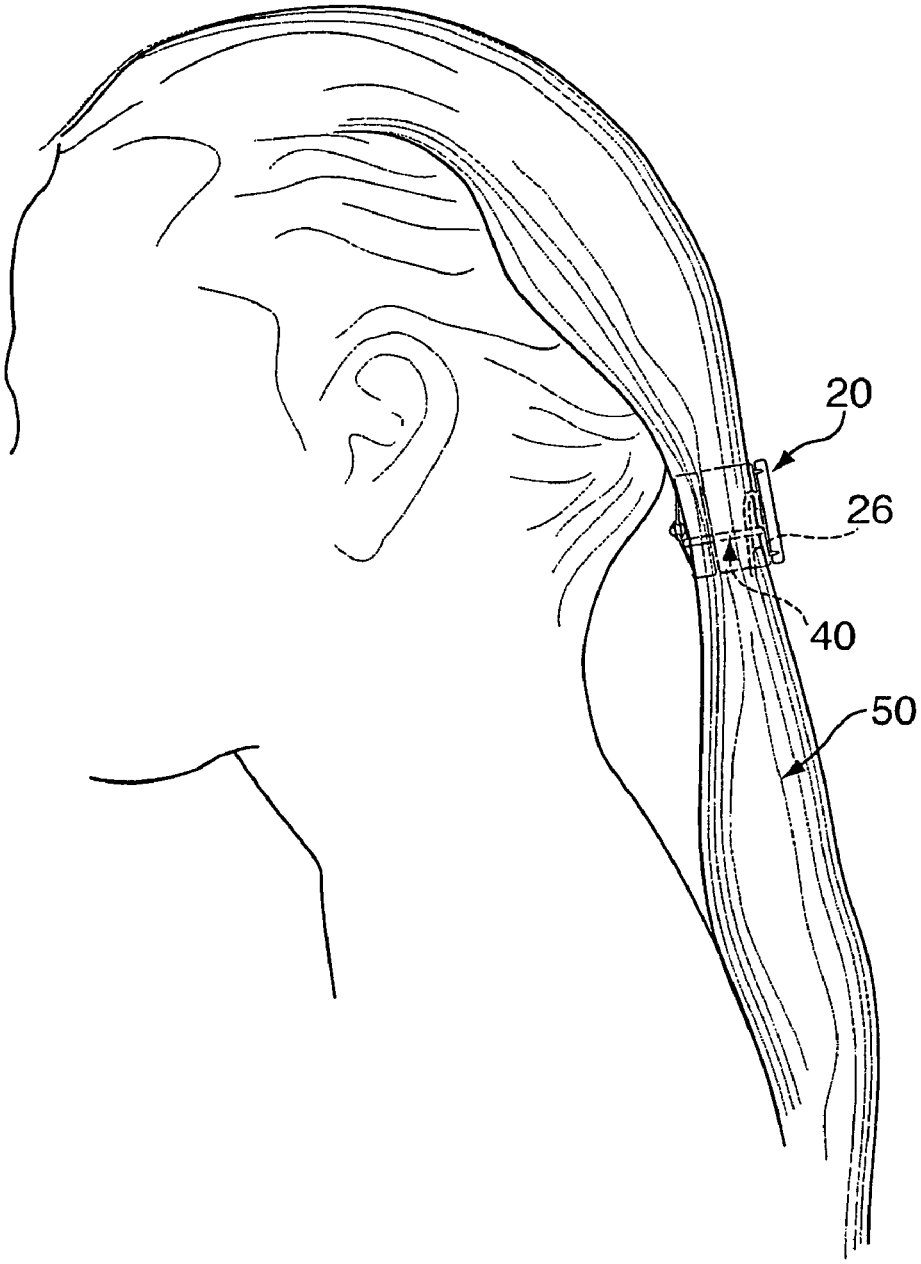
FIG. 7 is a perspective view of a portion of a ponytail incorporating applicants assemblage of an elastic band holding a bundle of hair in a ponytail and one of applicants decorative ponytail clips anchored to the ponytail.
Figure 8:
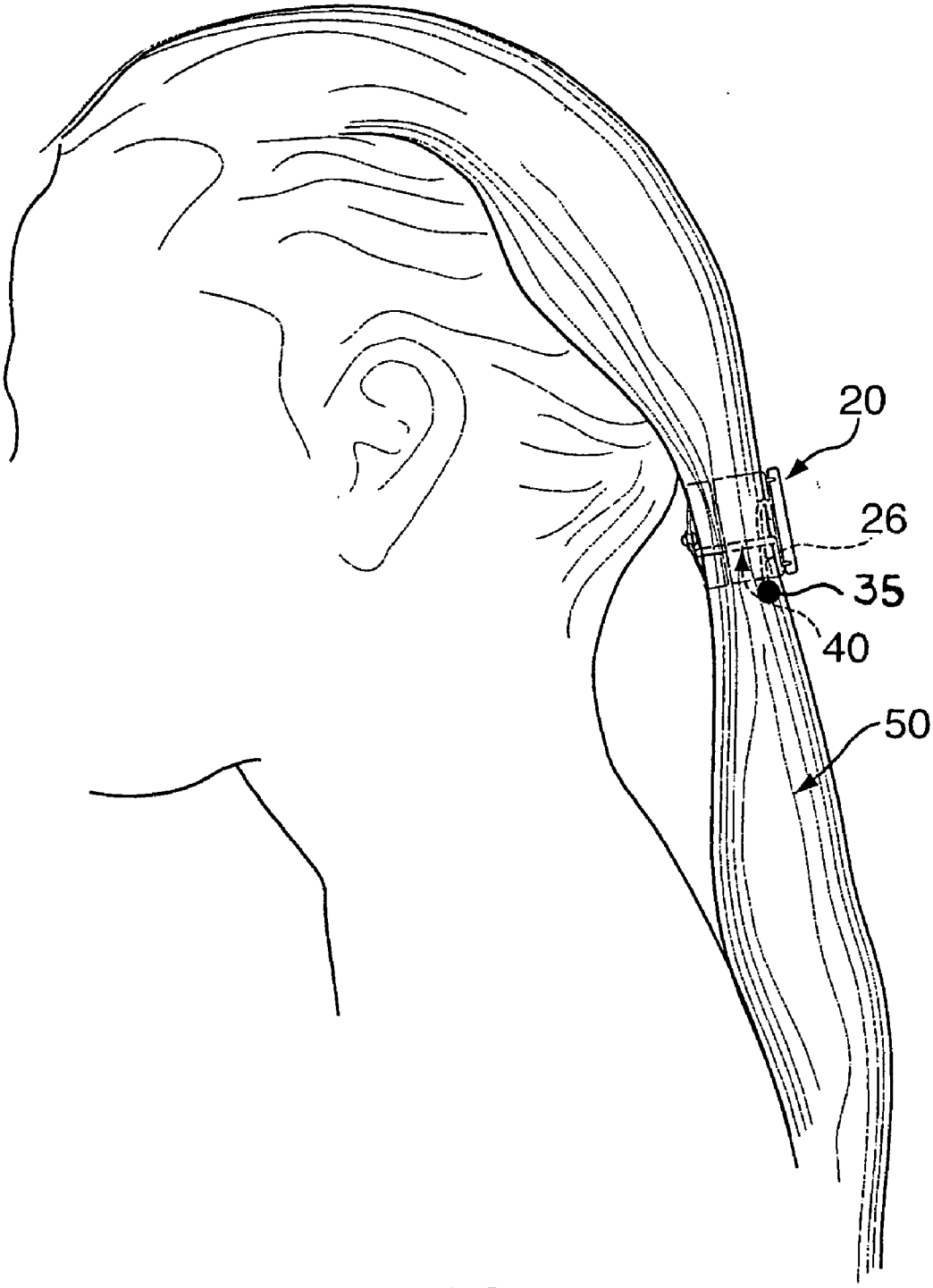
FIG. 8 is a perspective view of the embodiment of FIG. 7 showing a ball disposed on the distal end of the clip.

Each clip has an elongate pin secured thereto and projecting from the rear face thereof for penetrating into the pony tail at a position above the elastic band 40. This securely detachably anchors the clip to the ponytail. In the drawing clips 10, 20 and 30 are illustrated with respective pins 19, 22 and 34 secured at one end thereof to an inner face portion of one of a clip section associated therewith and they project therefrom at a selected angle (preferably an acute angle) thereto. The pin preferably has an enlargement thereon and by way of example pin 34 is shown with a spherical enlargement 35 on the free outer end thereof. The pins are located proximate mid length of the clip associated therewith as viewed in their lay out elongate open state as best illustrated in FIGS. 4-6.

A person desiring a ponytail hair style gathers their hair into a bundle (or has someone do so for them) and then slips an elastically stretchable band 40 over the same retaining it in a ponytail. A ponytail clip is selected and the pin thereof, for example pin 19 of clip 10, is inserted into the ponytail at a position above the elastic band. Opposite ends of the clip are joined together, in the case of permanent magnets, by bringing them into engagement with one another by holding means such as crimp beads or the like. The clip encircling the ponytail, if necessary, can be slid downwardly along the same bringing the pin 19 proximate or into engagement with the elastic band. The clip overlies the elastic band and thus conceals the same.

An extremely strong stretchable member available commercially and identified as STRETCH MAGIC latex free beading cord from Pepperell Crafts Company to be suitable for use as spans 13 and 14 onto which the individual clip elements are strung. It is a clear, transparent and at rest a single strand measures about 0.012" in thickness and about 0.05" wide. Of course it is contemplated that other polymers, elastomers such as rubber bands and metal, plastic, or cloth bands, wires, strips, fishing line or the like could be utilized in place of the elastic band described in a one preferred embodiment.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented herein above. Rather, what is intended to be covered is within the spirit and scope of the appended claims.

I claim:

1. An assemblage of components for decoratively retaining ones hair bundled together in a pony tail, said assemblage consisting of:

an elastically stretchable band for tightly circumscribing a bundled collection of hair retaining the same in a ponytail; and a decorative clip detachably securable to the ponytail at a position in overlying relation with respect to said band and thereby concealing the same, said clip comprising at least one elongate elastically stretchable unit terminating at opposite ends thereof in respective first and second interconnectible clasp portions said clip including a plurality of clip sections each having a decorative outer face and an inner face on the opposite side thereof and a pin secured to one of said clip sections, said at least one elongate elastically stretchable unit attaching to said internal face of each one of said clips at least at a selected top and bottom position in spaced apart alignment from one another extending between said clasp portions forming a loop therebetween, said pin projecting from an inner face of said one of said clip sections at a selected angle thereto projecting through said elastically stretchable band for penetrating into said bundled collection of hair in the pony tail at a position above said band and thereby anchoring the clip to said bundled collection of hair in the ponytail; and means for detachably connecting said clasps.

2. The assemblage of components as defined in claim 1 wherein said pin is disposed at an acute angle to said inner face.

3. The assemblage of components as defined in claim 1 including an enlargement on a portion of said pin penetrating the ponytail.

4. The assemblage of components as defined in claim 3 wherein said enlargement is disposed on an outer free terminal end portion of said pin.

5. The assemblage of components as defined in claim 1 wherein said clasp portions comprise a pair of magnets of opposite polarity.

6. The assemblage of components as defined in claim 1 wherein said decorative clip includes a plurality of decorative clip sections including an elongate elastically stretchable member and a plurality of said decorative clip sections mounting thereon in side-by-side relation.

7. The assemblage of components as defined in claim 6 wherein at least one elongate elastically stretchable unit said decorative elements are slidably mounted on said elongate stretchable member.

8. The assemblage of components as defined in claim 6 wherein said elastically stretchable member passes through aligned holes in the decorative members.

9. The assemblage of claim 1, wherein said pin projects beyond the periphery of said band and extends into said ponytail at a point above said elastically stretchable band for tightly circumscribing a bundled collection of hair projecting therethrough disposed within said ponytail.

10. The assemblage of components as defined in claim 1, wherein said elastically stretchable unit comprises a first span and a second span disposed in spaced apart parallel relation and connected at one end thereof to a first interconnectible clasp portion and at the opposite end to a second interconnectible clasp portion providing a closed loop clip.

11. The assemblage of components of claim 1 wherein said clip comprises a multi-section flexible elastically stretchable unit.

12. The assemblage of components of claim 11, wherein said clip has alternately arranged sections.

13. The assemblage of components of claim 11, wherein said clip comprises three side-by-side sections.

14. The assemblage of components of claim 11, wherein said clip includes a plurality of sections arranged in side-by-side parallel rows.

15. A decorative ponytail clip for covering an elastic band tightly circumscribing a bundled collection of hair retaining the same in a ponytail, said decorative clip detachably securable to said ponytail at a position in overlying relation with respect to said band and thereby concealing same, said decorative clip: consisting of:

at least two segments movably connecting together, each one having a decorative outer face and an oppositely disposed inner face, said at least two segments defining a first segment end and a second segment end;

spaced apart holding means attaching to said inner face of each of said at least two segments for aligning said at least two segments one with the other;

clasps means defining a first interconnecting portion connecting to said first segment end and a second interconnecting portion connecting to an opposing second segment end;

an elongate elastic member connecting said holding means of said first segment and said second segment with said first interconnecting portion of said clasp means and said second interconnecting portion of said clasp means; and a pin secured to an inner face of one of said at least two segments projecting downwardly therefrom at a selected acute angle extending through said elastic band and penetrating a collection of hair retained bundled together in said ponytail.

16. The decorative ponytail clip of claim 15, wherein said pin includes a retaining means attaching to its distal end.

17. The decorative ponytail clip of claim 15, wherein said retaining means attaching to its distal end comprises an enlargement extending from said distal end.

18. The decorative ponytail clip of claim 17, wherein said enlargement comprises a spherical member.

19. The decorative ponytail clip of claim 15, wherein said interconnecting portions of said clasp means are secured by at least one magnet.

20. The decorative ponytail clip of claim 15, wherein at least one of said interconnecting portions of said clasp means comprises a pair of magnets of opposite polarity.

21. The decorative ponytail clip of claim 15, wherein said spaced apart holding means comprises a pair of aligned holes in each of said clip segments.

22. A decorative ponytail clip for covering an an elastic band tightly circumscribing a bundled collection of hair retaining the same in a ponytail, said decorative clip detachably securable to said ponytail at a position in overlying relation with respect to said band and thereby concealing same, said decorative clip consisting essentially of:

a plurality of segments movably connecting together, each one having a decorative outer face and an oppositely disposed inner face, said plurality of segments including a first segment end and a second segment end;

spaced apart holding means attaching to said inner face of each of said plurality of segments for aligning said plurality of segments one with the other in side-by-side relation, clasps means defining a first interconnecting portion connecting to said first segment end and a second interconnecting portion connecting to an opposing second segment end;

an elongate elastic member connecting said holding means of said plurality of segments with said first interconnecting portion of said clasp means and said second interconnecting portion of said clasp means; and a pin secured to an inner face of one of said plurality of segments projecting downwardly therefrom at a selected acute angle extending through said elastic band and penetrating a collection of hair retained bundled together in said ponytail.

23. The decorative ponytail clip of claim 22, wherein said pin includes a retaining means attaching to its distal end.

24. The decorative ponytail clip of claim 22, wherein said interconnecting portions of said clasp means are secured by at least one magnet.

25. A decorative ponytail clip for covering an elastic band tightly circumscribing a bundled collection of hair retaining the same in a ponytail, said decorative clip detachably securable to said ponytail at a position in overlying relation with respect to said band and thereby concealing same, said decorative clip consisting essentially of:

at least two segments movably connecting together, each one having a decorative outer face and an oppositely disposed inner face, said at least two segments defining a first segment end and a second segment end;

spaced apart holding means attaching to said inner face of each of said at least two segments for aligning said at least two segments one with the other;

clasps means defining a first interconnecting portion connecting to said first segment end and a second interconnecting portion connecting to an opposing second segment end;

an elongate elastic member connecting said holding means of said first segment and said second segment with said first interconnecting portion of said clasp means and said second interconnecting portion of said clasp means; and a pin secured to an inner face of one of said at least two segments projecting downwardly therefrom at a selected acute angle extending through said elastic band and penetrating a collection of hair retained bundled together in said ponytail.

* * * * *